United States Patent [19]

Mehta

[11] 4,031,849

[45] June 28, 1977

[54] PUSH BUTTON SWITCH POSITION INDICATOR

[75] Inventor: Girishkumar Ratilal Mehta, Bombay, India

[73] Assignee: Mehta Engineering Enterprise, Maharashtra, India

[22] Filed: June 18, 1975

[21] Appl. No.: 587,804

[52] U.S. Cl. ..... 116/124 L; 200/309

[51] Int. Cl.[2] ..... H01H 9/16

[58] Field of Search ..... 116/124 R, DIG. 28, 116/135, 124 L; 200/308, 309, 314

[56] References Cited

UNITED STATES PATENTS

| | | | |
|---|---|---|---|
| 3,715,548 | 2/1973 | Schadow | 116/DIG. 28 |
| 3,845,736 | 11/1974 | Golbeck et al. | 116/124 R |
| 3,855,959 | 12/1974 | Hinze | 200/308 |

*Primary Examiner*—Richard C. Queisser
*Assistant Examiner*—Daniel M. Yasich

[57] ABSTRACT

A push button switch position indicator wherein a push button head with a window has a carrier mounted in the head to move longitudinally relative thereto, the carrier carrying a signal surface and at least one shutter which is responsive to the movements of the button head so that the signal surface is uncovered by the shutter when the button head is depressed, and covered thereby when the button head is not depressed.

6 Claims, 8 Drawing Figures

PUSH BUTTON SWITCH POSITION INDICATOR

This invention relates to a push button switch position indicator.

A push button switch position indicator serves to indicate the switched-on position of a push button switch from the outside or its switched-off position. For such purpose, a switch position indicating means in the form of a reflecting signalling surface is arranged behind a window in a push button head and fixed to a button frame; the signalling surface is located close to the window when the push button is depressed and away from the window when the button is not depressed. In the known art, a push button switch position indicator has a signal face arranged behind a window in a push button head so that when the push button of a push button switch is depressed, the signal face lies adjacent the window and when it is not depressed, it lies away from it. At least one covering shutter is provided in the push button head and is arranged to pivot about an axis which is perpendicular to the switch axis. The covering shutter also has a limb extending perpendicular from the shutter. The covering shutter is swung open on depressing the push button head; on the return of the push button head the limb is so swung from the rear side of the signal face carrier that the covering shutter is swung back over the signal surface.

In such a push button switch position indicator the shutter-like member is attached on the push button head. Also, the rear end of the carrier, on which the signal face is provided, carries snap-on hooks which hook into slots along two opposite sides of a switch frame.

Various disadvantages are found to arise out of such construction of a push button switch position indicator. One disadvantage is that the same button head cannot be used for vertical mounting and horizontal mounting as well, thereby necessitating the use of differently constructed button heads for vertical and horizontal mounting.

Another disadvantage is that the indicators cannot always be assembled or disassembled without being damaged. Also, such indicators require considerable skills for assembling or disassembling.

It is an object of this invention to obviate the aforesaid disadvantages and to provide an improved push button switch position indicator which can be easily assembled or disassembled in a simple manner.

Accordingly, this invention provides a push button switch position indicator having a longitudinal axis, comprising a push button head having a window and a carrier mounted thereinside for longitudinal movements towards and away from the window when the button head is moved longitudinally relative to the carrier; a signal surface carried by the carrier; at least one shutter attached to the carrier, the shutter being responsive to the longitudinal movement of the button head relative to the carrier for movement between two positions, the shutter is its first position providing visual detection of the signal surface through the window, and the shutter in its second position preventing detection of the signal surface through the window.

In an exemplary embodiment of the invention, the push button switch position indicator may comprise a push button head having a window fitted with a transparent cap and a carrier mounted thereinside for longitudinal movements towards and away from the window when the button head is moved longitudinally relative to the carrier; the carrier having a front end whereon a signal surface is provided and a pair of limbs extending longitudinally towards the rear end; at least one shutter; first means for attaching the shutter to the carrier at the front end thereof so that the shutter is rotatable about an axis perpendicular to the longitudinal axis; second means provided on the transparent cap for operating the first means so that on moving the button head relative to the carrier the shutter moves into a first position for providing visual detection of the signal surface through the window; and third means provided on the button head for operating the first means so that, on moving the button head relative to the carrier, the shutter moves into a second position for providing preventing visual detection of the signal surface through the window.

One or more shutters may be used. In an embodiment, the first means may comprise a pair of openings provided in the proximity of the signal surface in each limb of the carrier, a cam-like shoulder provided at each end of each shutter and carrying an inwardly projecting pin disposed perpendicular to the longitudinal axis so as to engage the corresponding opening in each limb; the second means comprise a pair of inwardly projecting shoulders provided on the transparent cap which abut and cause said cam-like shoulders to turn in one direction in the openings; and the third means comprise abutments or steps provided on the button head behind the cam-like shoulders so that they abut and cause the cam-like shoulders to turn in a reverse direction in the opening.

The aforesaid opening may be a hole or an extended slot.

In another embodiment, the pair of shutters may each be provided in the form of a hollow paraboloid and the first means comprise a pair of holes provided in the proximity of the signal surface in each limb of the carrier, a cam-like shoulder provided at each end of each shutter and carrying an inwardly projecting pin disposed perpendicular to the longitudinal axis so as to engage the corresponding hole in each limb; the second means comprise a pair of inwardly projecting shoulders provided on the transparent cap, each shoulder carrying a pair of projections adapted to abut the cam-like shoulders and cause them to turn in one direction in the holes; and the third means comprise abutments or steps provided on the button head behind the cam-like shoulders so that they abut and cause the cam-like shoulders to turn in a reverse direction in the opening.

The rear ends of the longitudinally extending limbs of the carrier may have hooks which hook into slots in a switch frame; the slots are provided along two oppositely disposed sides of the switch frame and also along sides adjacent the oppositely disposed sides so that the button head can be mounted in one plane or another plane perpendicular to the one plane to provide horizontal or vertical mounting.

Preferably, the walls of the push button head towards the end remote from the window are tapered.

Preferred exemplary embodiments of the invention will now be described with reference to the accompanying drawings, in which FIG. 1 shows an isometric cut-away view of a push button switch position indicator according to an embodiment of the invention when said indicator is mounted in a horizontal position onto a switch frame and when the switch is in the OFF-position;

Figure 1:
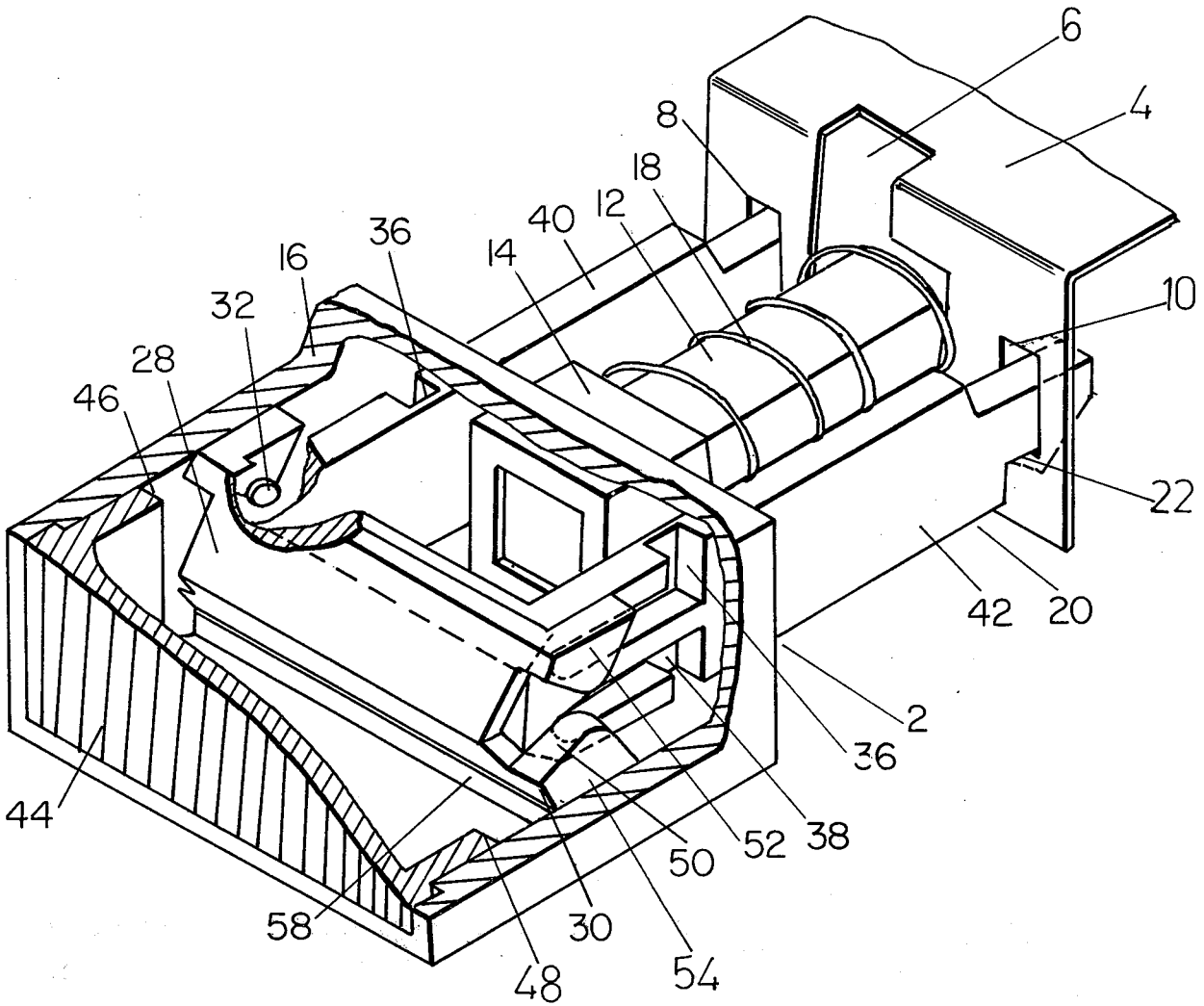
Figure 2:
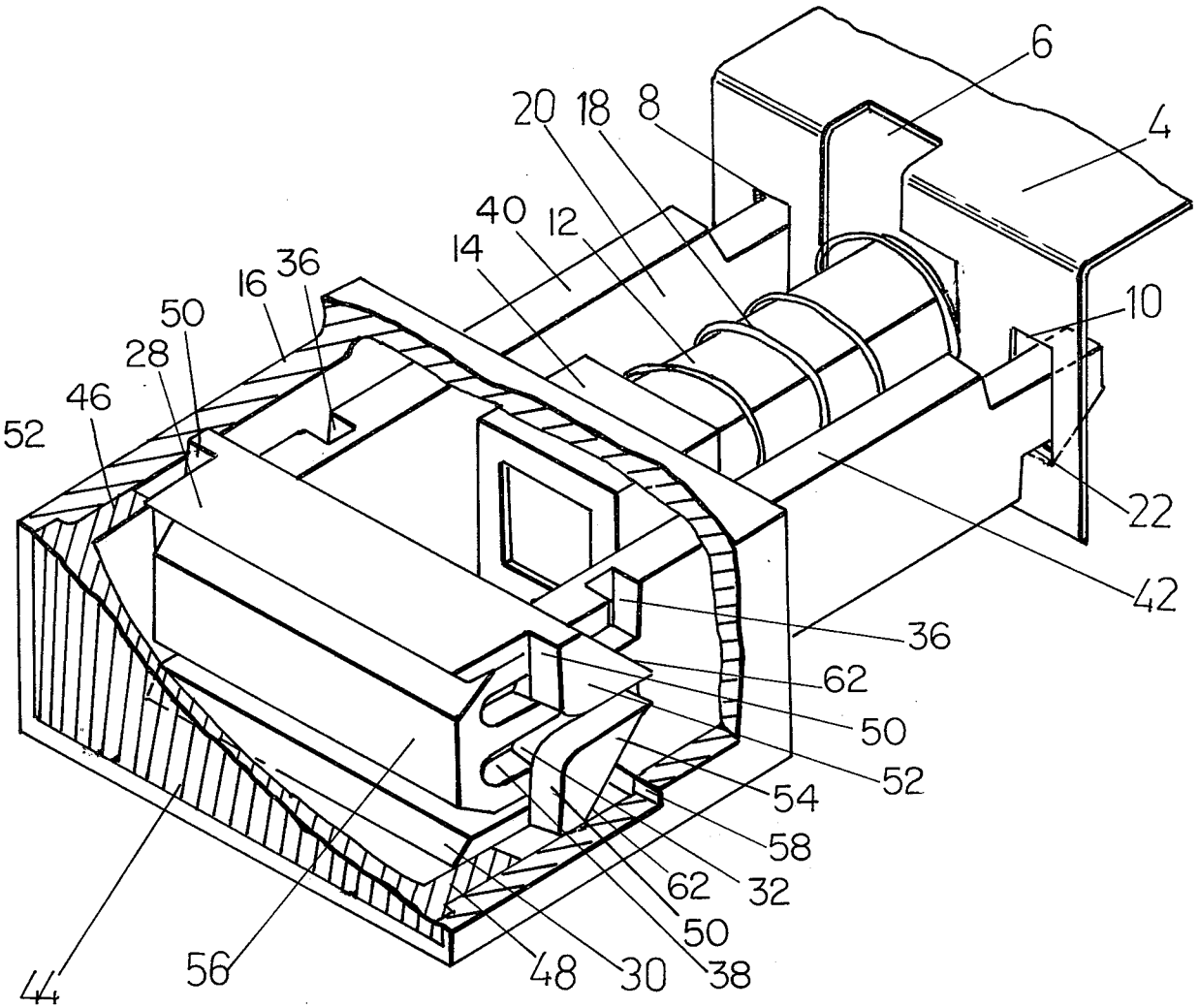
FIG. 2 shows an isometric view of the push button switch position indicator shown in FIG. 1, when the switch is in the ON-position.

Referring to FIGS. 1 and 2, a push button switch position indicator 2 is mounted on one side of a switch frame 4, which carries a slot 6 in its centre and a pair of slots 8 and 10 on either side of the slot 6; through the latter, a push button plunger 12 of the push button switch projects. The plunger 12 is connected via suitable brace means 14 in a fixed manner to a push button head 16. A compression spring 18 required for return movement of the push button head 16 surrounds the push button plunger 12 and rests on the one hand against a flange (not shown) integral with the plunger 12 and on the other hand against the switch frame 4.

In the push button head 16, there is provided a signal surface carrier 20 which slides longitudinally relative to the button head; the carrier at its rear end has hooks 22 for detachably engaging the slots 8 and 10 of the switch frame 4. The hooks 22, such as illustrated, along with tapering ends 24 and 26 (FIG. 3) of the push button head, facilitate assembly or disassembly in a simple manner without any risk of damage to the carrier or other parts of the indicator. The carrier 20 is easily engaged or detached from the frame 4 by manually engaging or releasing the hooks 22 from the slots 8 and 10 shown in FIG. 1. The tapering ends 24, 26 of the push button head (see FIG. 3) facilitates such assembly or disassembly of the carrier 20 from the switch frame because they provide sufficient space for lateral movement of the carrier during engagment or disengagement of the hooks 22 from the slots 8, 10 in the switch frame. As shown in FIGS. 1 and 2, the indicator is mounted in a horizontal position with the longer sides of the button head parallel to the longer side of the switch frame 4. A pair of shutters 28 and 30 (FIG. 2) having cam-like shoulders 52 and 54 on each side of each shutter respectively, which can be pivoted about pins or bearings 32, 34 (FIG. 2) within longitudinally extending slots or grooves 36 and 38 each of limbs 40 and 42 of carrier 20 located within push button head 16 are provided. Since the shutters are mounted on the carrier, the carrier along with the shutters form a composite sub-assembly as distinct from the other parts which facilitates assembling and disassembling operations.

The shutters 28 and 30 can only be viewed through a transparent cap 44 having shoulders 46 and 48 fitted to a window of push button head 16 so long as the said push button 16 is not depressed, i.e. it is in the 'OFF' position as indicated in FIG. 1.

Figure 3:
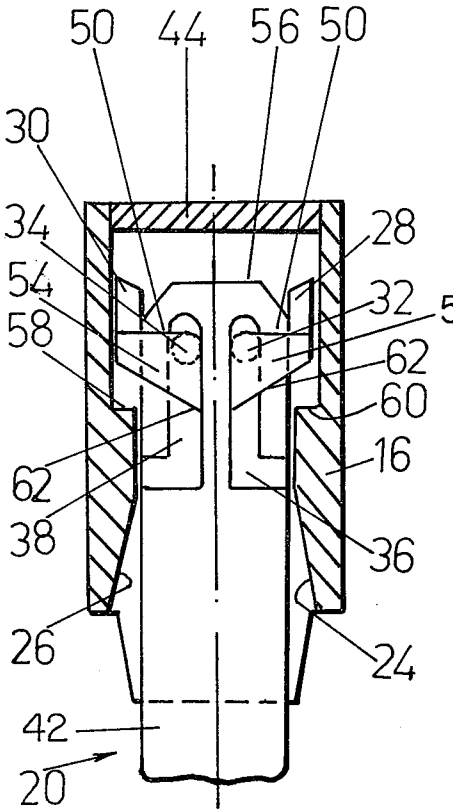
FIG. 3 shows a sectional side view of the push button switch position indicator shown in FIG. 2.
Figure 4:
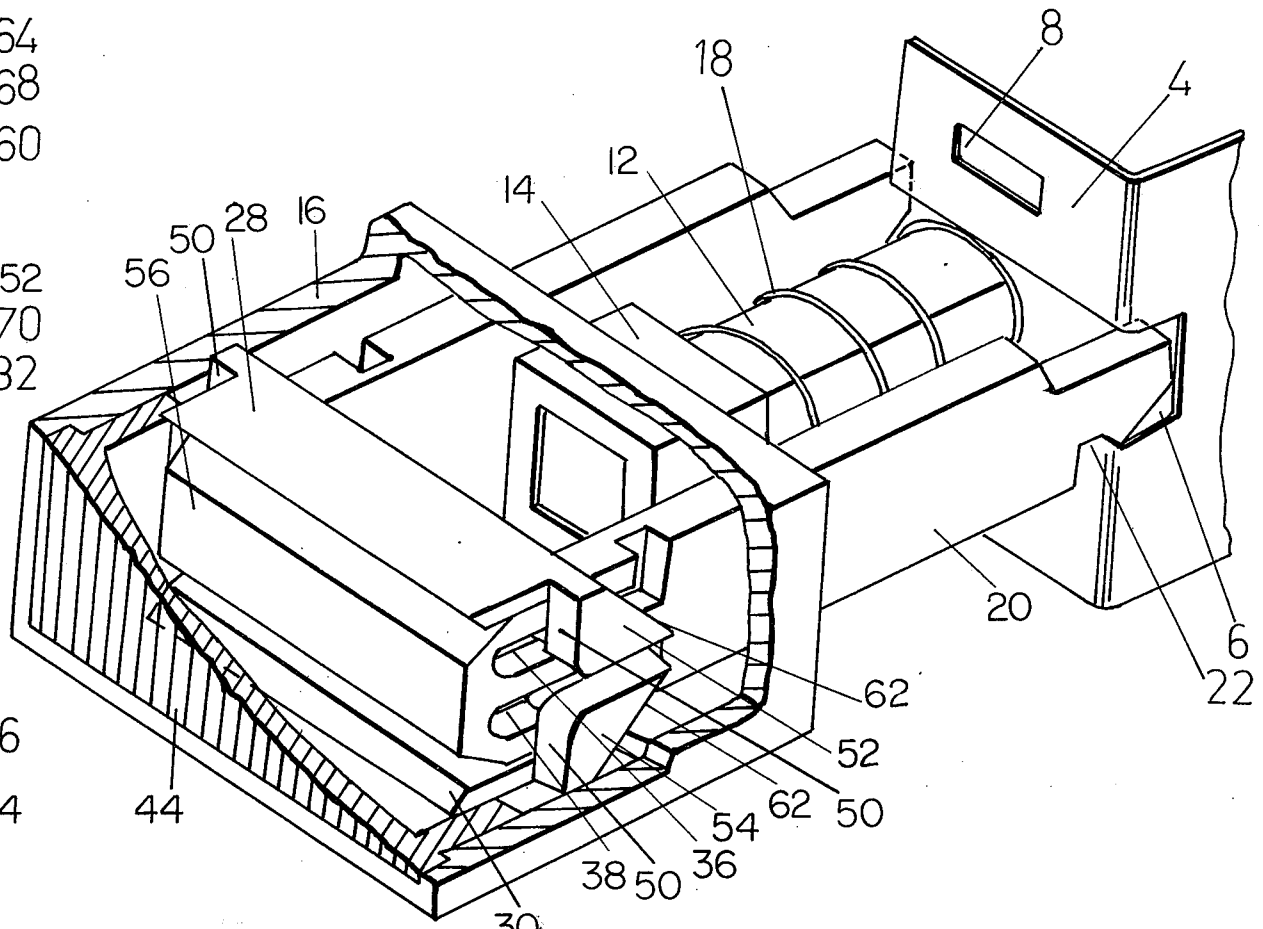
FIG. 4 shows an isometric cut-away view of the push button switch position indicator shown in FIG. 2 when the push button is mounted in a vertical position onto the switch frame.

In FIG. 4, in which like references indicate parts identical to those shown in FIGS. 1 to 3, the switch position indicator is mounted in a vertical position with the hooks 22 in engagement with the slots 6 of the switch frame 4.

Referring to FIGS. 2 and 3, if the push button head 16 is depressed the shoulders 46 and 48 (FIG. 1) of the transparent cap 44 striking against the front side 50 of the cam-like shoulders 52 and 54 of the shutters 28 and 30 initiate the rotation of the shutters about the axis formed by the pins 32 and 34 provided on the inner surface of the shoulders 52 and 54, respectively, and the travel of the shutters within the slots or grooves 36 and 38 on carrier 20; thereby a signal surface 56 (FIG. 2) of the carrier 20 is brought towards the transparent cap 44 and the signal surface 56 is rendered visible through the window of the push button head 16 to indicate the 'ON' position of the push button switch (not shown).

The reverse occurs when the push button head 16 is released for switching OFF the push button switch (not shown), whereby steps 58 and 60 (FIG. 3) of the push button head 16 striking against the rear 62 of the cam-like shoulders 52 and 54 of shutters 28 and 30, respectively, initiate simultaneous rotation and travel of the shutters within the respective slots or grooves 36 and 38 of the carrier 20, and the latter is moved away from the transparent cap 44, and the signal surface 56 (FIG. 2) is covered by the shutters 28 and 30, thereby preventing the detection of the signal surface 56 through the cap 44, giving visible indication that the switch is in the OFF position.

Figure 5:
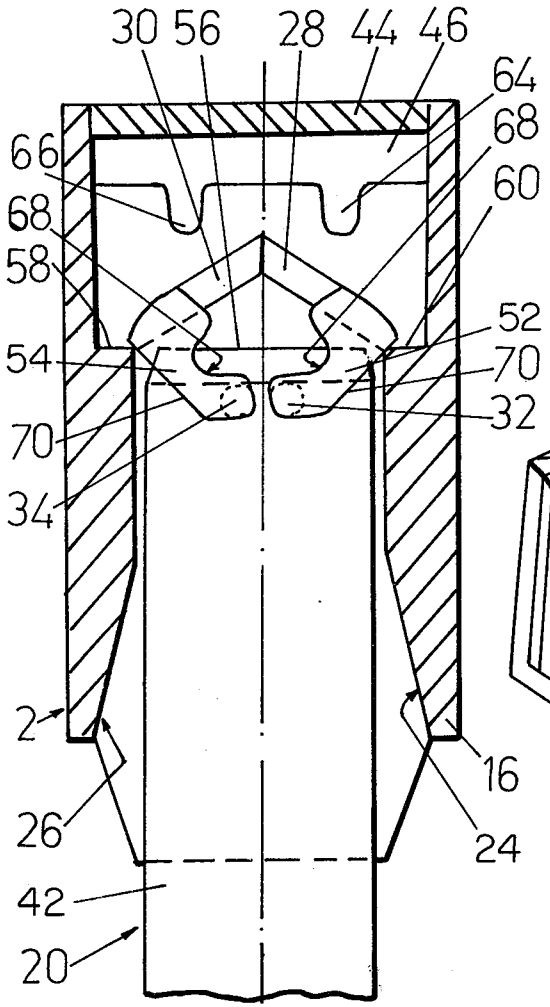
FIG. 5 shows a sectional side elevation of the push button switch position indicator according to another embodiment of the invention, when the switch is in the OFF position.
Figure 6:
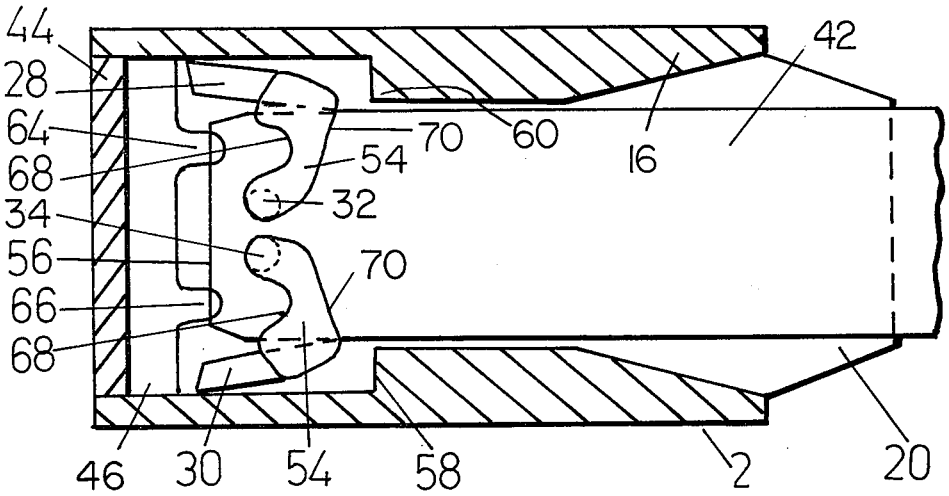
FIG. 6 shows a sectional side elevation of the push button indicator shown in FIG. 5 when the switch is in the ON position.

It is also possible to provide the push button switch position indicator 2, as shown in FIGS. 5 and 6, with a pair of projections 64 and 66 on the shoulder 46, 48 (only shoulder 46 being seen) on the transparent cap 44, which projections 64, 66 are capable of striking against a cam surface 68 formed on the front side of the cam-like shoulders 52 and 54 of shutters 28 and 30 to initiate rotation of the shutters about the axis formed by the pins 32, 34 provided on the inside surface of the cam-like shoulders 52 and 54 and located within corresponding holes formed in the limbs 40, 42 (only limb 42 is seen) of the carrier 20, thereby bringing the signal surface 56 towards the transparent cap 44. The exposed signal surface 56 thus becomes visible through the window of the push button head 16 when depressed as shown in FIG. 6, thereby giving a visible indication that the push button type switch (not shown) is in the ON position.

The reverse occurs when the push button head 16 is released from its depressed position, the steps 58 and 60 of the head 16 striking against the rear 70 of the cam-like shoulders 52 and 54 of shutters 28 and 30, initiating the reverse rotation of the shutters about the axis formed by said pins 32 to cover the signal surface 56 of the carrier 20, which is pushed away from the window of the push button head 16, thereby preventing detection of the signal surface 56 through the transparent cap 44, thus giving a visual detection that the push button switch (not shown) is in the OFF position.

In the embodiment shown in FIGS. 7 and 8, a single shutter 29 is provided for covering the entire signal surface 56 of the carrier 20, and the operation of the shutters 29 is effected in the same manner as in the case of the indicator having two shutters, described hereinabove with like reference numerals indicating identical parts.

Figure 7:
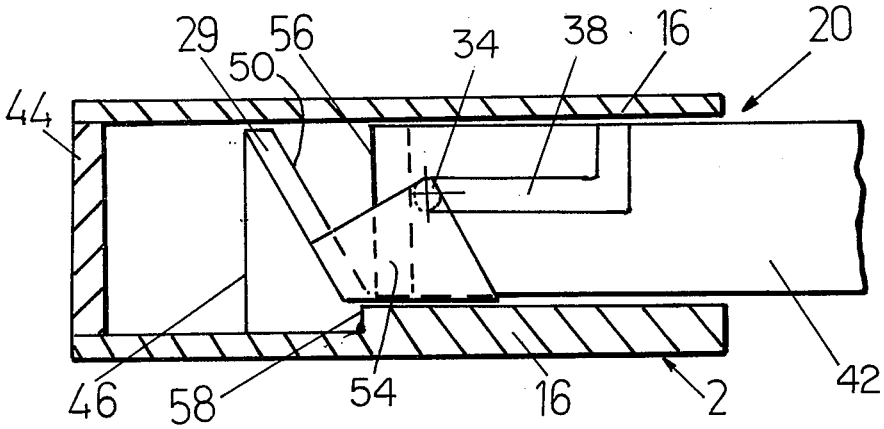
FIG. 7 shows a sectional elevation of a push button switch position indicator according to another embodiment of the invention, when the switch is in the OFF position.
Figure 8:
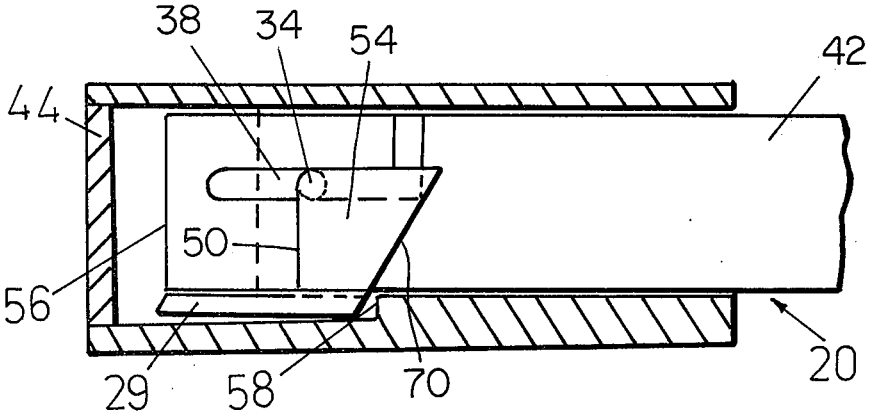
FIG. 8 shows a sectional elevation of the push button switch position indicator shown in FIG. 7 when the switch is in the ON position.

Referring to FIG. 7, when push button head 16 is depressed, the shoulders 46, 48 (FIG. 1) of the transparent cap 44, striking against the front 50 of the cam-like shoulders 54 of the shutter 29, initiate the rotation of the shutter about the axis formed by the pins 34 provided on the inner surface of the shoulders 54 and the travel of the shutter 29 within corresponding slots or grooves 38 on carrier 20. Thereby, the signal surface 56 (FIG. 2) of the carrier 20 is brought towards the cap 44 and the signal surface 56 is rendered visible (as shown in FIG. 8) through the window of the push button head 16 to indicate the "on" position of the push button switch (not shown).

The reverse occurs when the push button head is released from its depressed position, the steps 58 of the head striking against the rear 70 of the shoulders 54 of the shutter 29, initiating the reverse rotation of the shutter about the axis formed by the pins 34, to cover the signal surface 56 (FIG. 7), thereby giving a visual detection that the push button switch 6 is in the "off" position.

I claim:

1. A push button switch indicator (2) having a longitudinal axis comprising:

a. a push button head (16) having a window fitted with a transparent cap (44) and a carrier (20) detachably mounted to switch frame means (4), said carrier being mounted in said head for longitudinal movement towards and away from said window while said head is maintained longitudinally by spring means (18) relative to said carrier and said frame means;

b. said carrier having a front end whereon a signal surface (56) is provided and a pair of limbs (40, 42) extending longitudinally towards the rear end of said carrier;

c. at least one shutter means (28, 30);

d. first attaching means (32, 34; 36, 38; 52, 54) provided on said carrier for mounting on the latter said shutter means at said front end of the carrier so that said shutter means is rotatable about bearing means forming an axis perpendicular to the longitudinal axis;

e. first operating cam means (46, 48) provided on said cap and co-acting with said first attaching means for operating the latter so that, on moving said head relative to said carrier, said shutter means pivotally moves into its "on" or first position for providing visual detection of said surface through said window; and f. second operating cam means (58, 60) provided on said head and co-acting with said first attaching means for operating the latter so that, on moving said head relative to said carrier, said shutter means pivotally moves into its "off" or second position for preventing the detection of said surface through said window.

2. The push button switch indicator as defined in claim 1, wherein said shutter means comprises a pair of shutters provided, each in the form of a hollow paraboloid, and wherein a. said first actuating means has a pair of holes (for 32, 34) in each of said limbs (40, 42), provided in the proximity of said signal surface (56), a cam-like shoulder (52, 54) at each end of said shutters and carrying an inwardly projecting pin (32, 34) perpendicular to the longitudinal axis so as to engage the corresponding one of said holes in each of said limbs;

b. said first operating cam means has a pair of inwardly projecting shoulders (46, 48) on said cap (44), each of said projecting shoulders carrying a pair of projections (64, 66) so that they abut said cam-like shoulders and cause the latter to turn in one direction in said holes; and c. said second operating cam means has abutments (58, 60) on said head (16) behind said cam-like shoulder so that they abut the latter and cause them to turn in said holes in a direction reverse with respect to the one direction.

3. The push button switch position indicator as defined in claim 1, wherein walls (24, 26) of said head (16) are tapered towards the end remote from said window.

4. The push button switch position indicator as defined in claim 1, wherein a pair of said shutters (28, 30) is provided;

a. said first attaching means has a pair of openings (36, 38) in each of said limbs (40, 42), in the proximity of said signal surface (56), a cam-like shoulder (52, 54) at each end of said shutters and carrying an inwardly projecting pin (32, 34) perpendicular to the longitudinal axis so as to engage the corresponding one of said openings in each of said limbs;

b. said first operating cam means has a pair of inwardly projecting shoulders (46, 48) on said cap (44), which abut said cam-like shoulders and cause the latter to turn in one direction in said openings; and c. said second operating cam means has abutments (58, 60) on said head (16) behind said cam-like shoulders so that they abut the latter and cause them to turn in said openings in a direction reverse with respect to the one direction.

5. The push button switch position indicator as defined in claim 4, wherein said openings (36, 38) are extended slots.

6. The push button switch position indicator as defined in claim 1, wherein said switch frame means (4) has slots (6, 8, 10) therein, and wherein the rear ends of said limbs (40, 42) have hooks (22) which hook into said slots, the latter being provided in said switch frame means along two oppositely disposed sides thereof and also along sides adjacent said oppositely disposed sides so that said head (16) can selectively be mounted in two mutually perpendicular planes to provide selective horizontal and vertical mounting.

* * * * *